US005249312A

United States Patent [19]

Chang

[11] Patent Number: 5,249,312

[45] Date of Patent: Oct. 5, 1993

[54] CONTROL DEVICE FOR A WATER TANK

[76] Inventor: Fong-Chyi Chang, 72, Ming Lie Street, Taichung, Taiwan

[21] Appl. No.: 829,705

[22] Filed: Feb. 3, 1992

[51] Int. Cl.[5] ..... E03D 1/14

[52] U.S. Cl. ..... 4/325

[58] Field of Search ..... 4/324, 325, 379–384, 4/410–415

[56] References Cited

U.S. PATENT DOCUMENTS

| | | | |
|---|---|---|---|
| 4,216,555 | 8/1980 | Detjen | 4/324 |
| 4,651,359 | 3/1987 | Battle | 4/325 X |
| 4,748,699 | 6/1988 | Stevens | 4/325 X |
| 4,945,581 | 8/1990 | Harris | 4/325 |
| 5,023,960 | 6/1991 | Ratanagsu | 4/324 X |
| 5,191,661 | 3/1993 | Chang | 4/324 |

*Primary Examiner*—Charles E. Phillips

[57] ABSTRACT

A control device including a tube and an outlet pipe disposed in the water tank, a valve disposed on top of the outlet pipe, a pawl rotatably supported on top of the tube, a float slidably engaged on the tube, a pusher disposed below the float, the float will be caught by the pawl when the float moves downward, the outlet pipe will be closed by the valve after all of the water has been discharged, and the float will not be caught by the pawl when the knob is released right after depression so that the float may move downward to push the valve.

4 Claims, 6 Drawing Sheets

CONTROL DEVICE FOR A WATER TANK

BACKGROUND OF THE INVENTION

1. Field of the Invention

The present invention relates to a control device, and more particularly to a control device for a water tank or a flush tank.

2. Description of the Prior Art

Typical water tanks, particularly flush tanks, include an outlet valve from which water may flow out for flushing purposes. Generally, the water volume flowing out of the flush tank is predetermined and can not be adjusted so that the same amount of water will be discharged whenever the outlet valve is opened. This wastes water because, in some cases, the required water volume is less than the predetermined volume.

The present invention has arisen to mitigate and/or obviate the afore-described disadvantages of the conventional control devices for water tanks.

SUMMARY OF THE INVENTION

The primary objective of the present invention is to provide a control device disposed in a water tank in order to control the discharged water volume of the water tank.

In accordance with one aspect of the invention, there is provided a control device including a tube and an outlet pipe disposed in a water tank, a valve disposed on the upper end of the outlet pipe, a block fixed on an upper end of the tube, a hanger laterally extended from the block, a pawl rotatably supported on the hanger and including a hook formed on a first leg and a second leg; a float slidably engaged on the tube and movable upward and downward along the tube, a catch laterally extended from the float, a pusher disposed below the float and moving in concert with the float, a lever having a middle portion pivotally supported in an upper portion of the water tank and including a knob formed in a first end thereof and including a second end which is movable upward and downward when the knob is depressed and released, the second leg of the pawl being disposed above the lever and arranged such that the pawl can be caused to rotate about the hanger by the lever, the hook of the pawl being caused to move to a position located below the catch of the float when the second leg of the pawl is elevated, the knob being reachable from outside of the water tank, a cable coupled between the second end of the lever and the valve so that the valve can be pulled open when the second end of the lever moves upward and so that water contained within the water tank can be discharged via the outlet pipe, whereby, the float is lowered when the water discharges out through the outlet pipe, the catch of the float is caught by the hook of the pawl when the float moves downward and when the knob is depressed for a short period of time, so that the valve will move downward to close the outlet pipe after almost all of the water contained within the water tank has been discharged, and the catch of the float will not be caught by the hook of the pawl when the knob is released right after depression operation thereof so that the float may move downward along the tube and so that the valve can be pushed downward by the pusher in order to close the outlet pipe.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
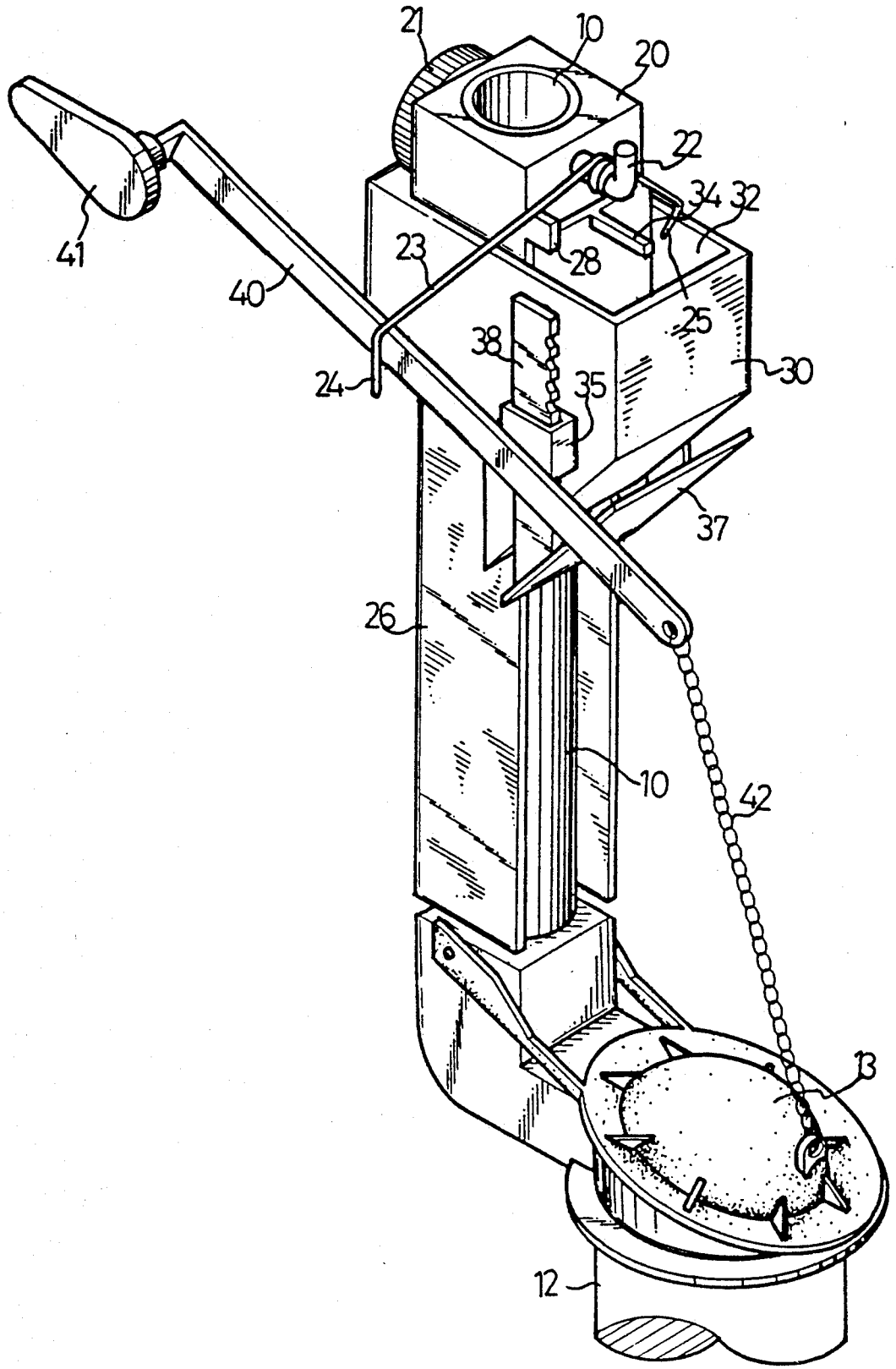
FIG. 1 is a perspective view of a control device for water tanks and flush tanks in accordance with the present invention.
Figure 4:
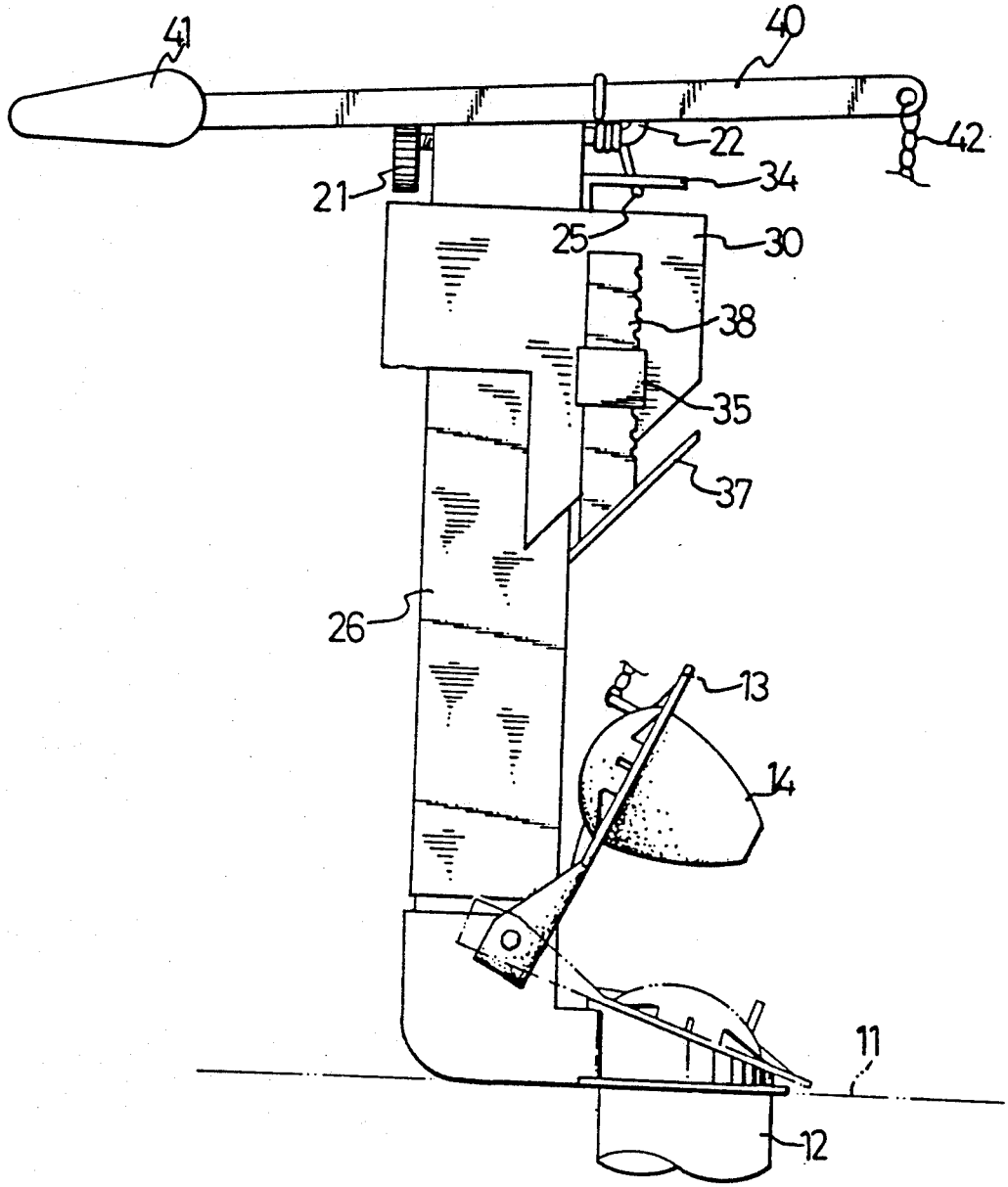
FIGS. 4 and 5 are plane views illustrating the operations of the control device, in which the water contained in the water tank is fully discharged.
Figure 5:
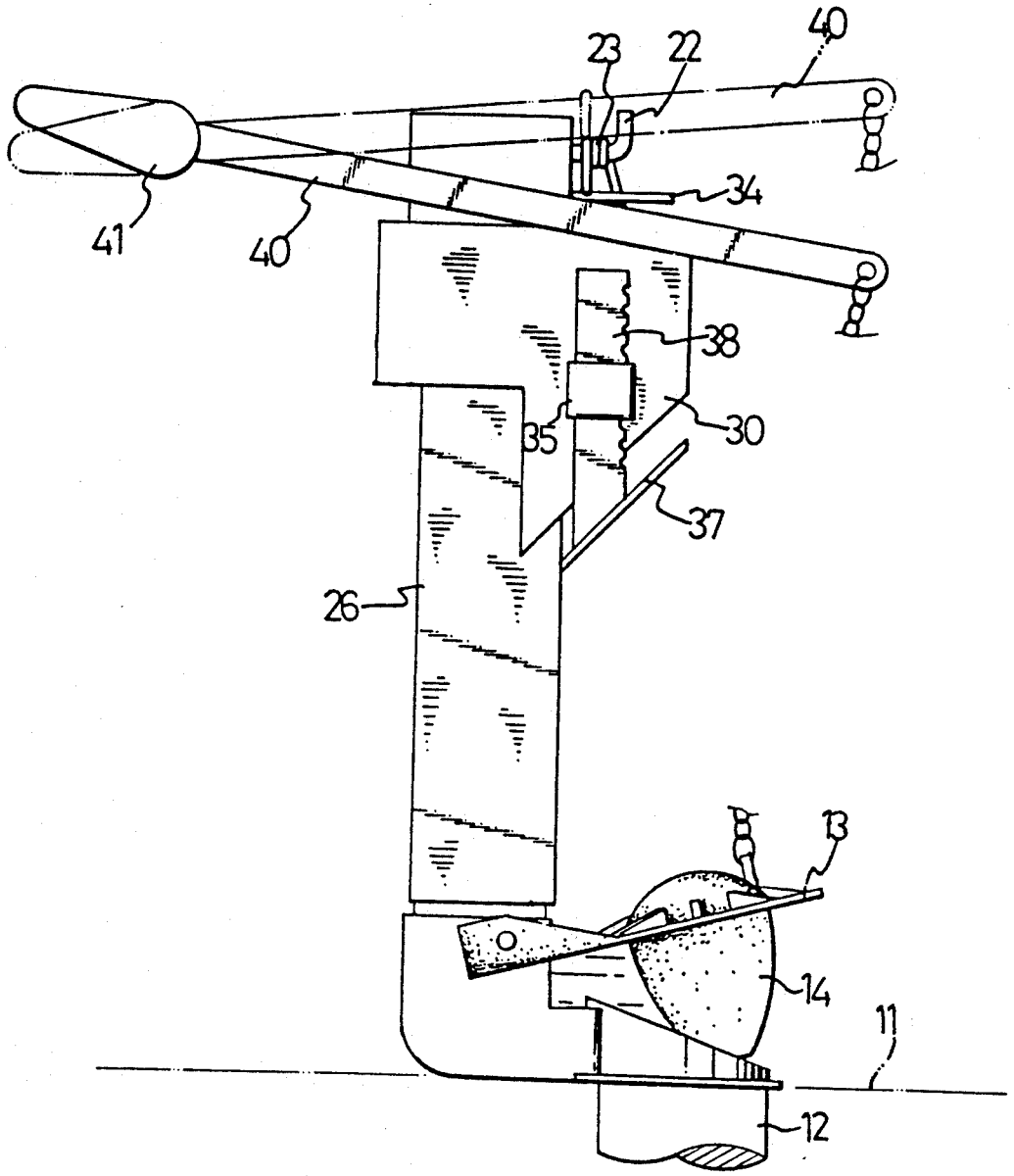
Figure 6:
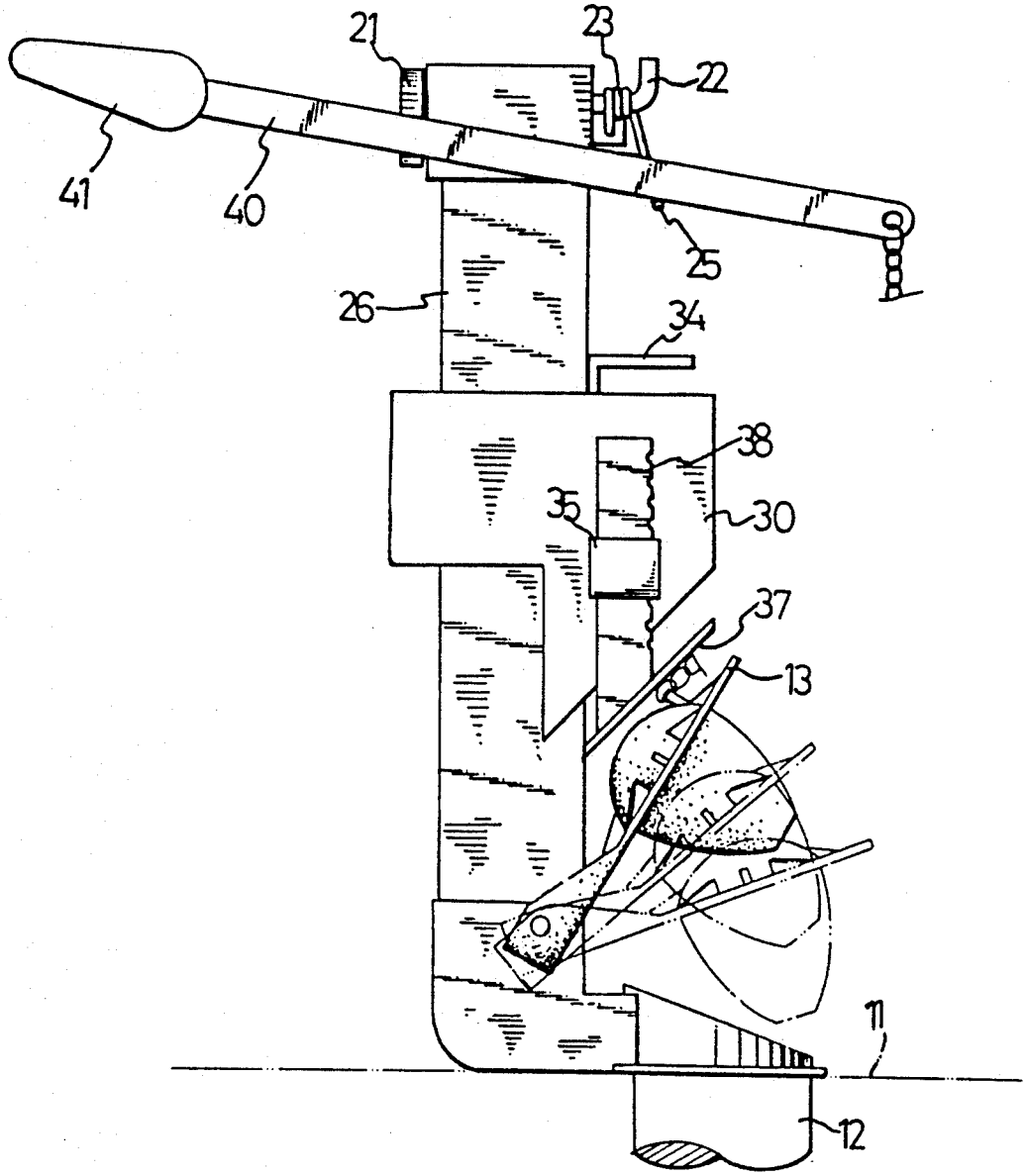
FIG. 6 is a plane view, similar to FIGS. 4 and 5, illustrating the operations of the control device, in which the water contained in the water tank is partly discharged.

Referring to FIG. 1, a control device comprises a tube 10 disposed in a water tank 11 (FIG. 4), an outlet pipe 12 disposed in the bottom of the tank 11, the tube 10 having an open upper end and having a lower end connected to the outlet pipe 12 so that excessive water can flow out via the tube 10, a valve 13 disposed on the upper portion of the outlet pipe 12 for opening and closing the outlet pipe 12, the valve 13 includes a float 14 (FIG. 4) which is received in the outlet pipe 12 when the valve 13 is in a close position (FIG. 1), and the float 14 is buoyed upward by the water contained within the tank 11 when the valve 13 is in an open condition (FIG. 4), in which water flows outward of the outlet pipe 12 when the valve 13 is opened.

A block 20 is fixed on top of the tube 10 by a bolt (FIG. 4) which has a knob 21 disposed on one end thereof. A hanger 22 is fixed on the block 20. A pawl 23 which has a middle portion rotatably engaged on the hanger 22 includes a hook 25 formed on the free end portion of a first leg thereof and a bent portion 24 formed on the free end portion of a second leg thereof. A pair of plates 26 are oppositely fixed on the side portions of the block 20 and extended downwards from the block 20 and located beside the tube 10. A stop 28 is formed on the block 20. The second leg of the pawl 23 can be supported on the stop 28.

Figure 2:
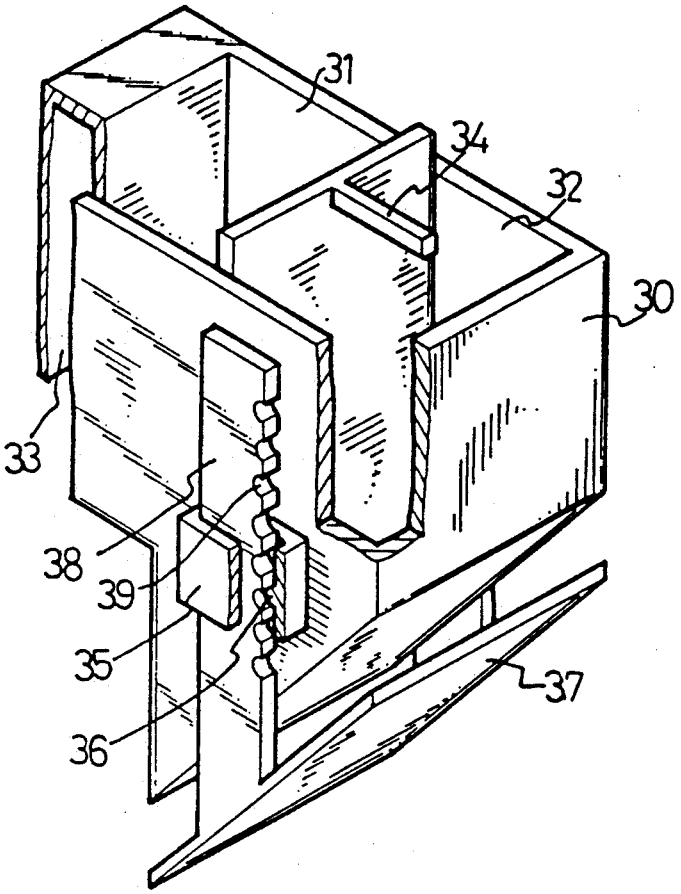
FIG. 2 is a perspective view of the float, in which part of the float is cut off.

As shown in FIGS. 1 and 2, a float 30 includes a substantially rectangular opening 31 formed in the center portion thereof for slidably engaged on the plates 26 so that the float 30 can be guided to move up and down along the plates 26 and so that the float 30 is prevented from rotating relative to the tube 10. The stop 28 limits the upward movement of the float 30. The float 30 is preferably made of light weight materials, such as plastic material so that the float 30 can be buoyed upward by the water contained within the water tank 11. The float 30 includes a first chamber 32 and a second chamber 33 oppositely formed therein. The first chamber 32 opens upward so that water can be contained within the first chamber, and the water contained within the first chamber 32 can be used as a weight for facilitating the downward movement of the float 30. The second chamber 33 opens downward so that gas can be contained within the second chamber 33 in order to increase the buoyant capability of the float 30.

A catch 34 laterally extends from the upper portion of the float 30. The float 30 includes two side surfaces each having a casing 35 formed thereon, each of the casing 35 has a protrusion 36 formed in the interior thereof. A pusher 37 includes two legs 38 extended upward therefrom for slidable engagement with the casings 35 respectively. Each of the legs 38 includes a plurality of depressions 39 formed therein for engagement with the protrusions 36 of the casings 35. The pusher 37 can be adjusted upwards and downwards relative to the float 30 by the engagement between the protrusions 36 and the depressions 39.

Figure 3:
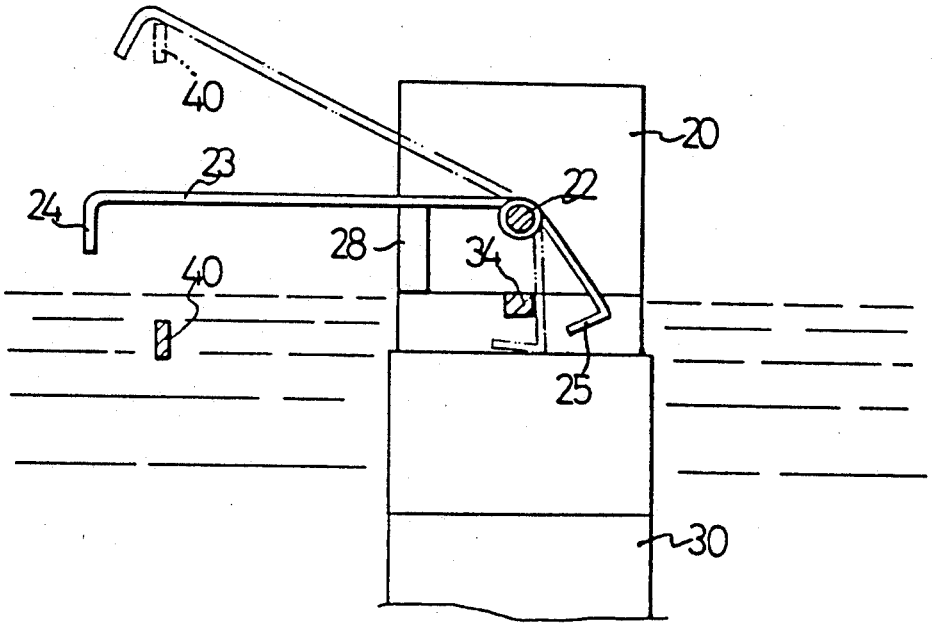
FIG. 3 is a schematic view illustrating the operations of the lever.

Referring again to FIG. 1, a lever 40 has a middle portion pivotally supported on the water tank 11 and is preferably located above the tube 10. The lever 40 includes a knob 41 formed in a first end and a second end extended inwards of the water tank 11. A cable 42 is coupled between the second end of the lever 40 and the valve 13. The knob 41 is reachable from outside of the water tank 11 so that the valve 13 can be pulled open and can be closed by the operations of the knob 41. The second leg of the pawl 23 is straddled on the lever 40 so that the pawl 23 can be caused to rotate about the hanger 22 by the lever 40, best shown in FIG. 3. The bent portion 24 of the pawl 23 maintains the engagement between pawl 23 and the lever 40. When the second leg of the pawl 23 is moved upwards by the lever 40, as shown in dotted lines in FIG. 3, the hook 25 of the pawl 23 can be caused to move the position located below the catch 34 so that the float 30 can be retained in the upper position by the hook 25.

In operation, referring next to FIG. 4 and again to FIG. 1, when it is required to discharge the water contained within the water tank, the knob 41 is pressed downward in order to elevate the second end of the lever 40 such that the valve 13 can be opened and such that the water contained within the water tank 11 can flow out through the outlet pipe 12, the float 14 will be buoyed by the water contained within the water tank 11 so that the valve 13 can be maintained in the open position; simultaneously, the pawl 23 can be caused to rotate about the hanger 22 and is rotatable from the first position as shown in solid lines to the second position as shown in dotted lines (FIG. 3), so that the hook 25 can be caused to move to the position located below the catch 34. When the knob 41 is maintained in the downward position for about three to five seconds, i.e., the knob 41 is still pressed downward by the user, the water level contained within the water tank 11 will be lowered and the float 30 will also be lowered such that the catch 34 will be caught by the hook 25 and such that the float 30 will not further move downward. At this moment, the knob 41 can be released. The valve 13 will move downward to close the outlet pipe 12 when almost all of the water contained within the water tank 11 has been discharged.

It is to be noted that the pawl 23 will be maintained in the first position (solid lines, FIG. 3) by gravity when the knob 41 is not pressed downward by the user, such that the pawl 23 will be recovered to the first position when the float 30 is caused to move upward again by the water filled into the tank 11.

However, when it is required to discharge only part of the water contained within the water tank, the knob 41 is also pressed downward by the user, but the knob 41 should be released within about three seconds, preferably released right after depression of the knob 41, before the catch 34 is caught by the hook 25, accordingly, the float 30 moves downward when the water level is lowered. The valve 13 will be depressed to close the outlet pipe 12 by the pusher 37 before all of the water contained within the water tank 11 has been discharged. When the pusher 37 is adjusted downward relative to the float 30, the distance between the pusher 37 and the float 30 is increased such that the valve 13 will be closed earlier and such that the water volume flowing out of the water tank 11 will be decreased.

Accordingly, the discharged water volume of the water tank controlled by the control device in accordance with the present invention can be adjusted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control device for a water tank comprising a tube vertically disposed in said water tank and having an upper end, an outlet pipe including an upper end communicated with said water tank, a valve disposed on said upper end of said outlet pipe for opening and closing said outlet pipe, said device comprising, a block fixed on said upper end of said tube, a stop provided on said block, a hanger laterally extended from said block, a pawl having a middle portion rotatably supported on said hanger and including a first leg having a hook formed thereon and a second leg; a float slidably engaged on said tube and movable upward to a point where it contacts said stop and downward along said tube for engaging with said valve, a pusher disposed below said float and moving in concert with said float in order to close said valve when said float moves downward, said float including two side surfaces each having a casing formed thereon, said pusher including two third legs extended upward for slidable engagement with said casings so as to couple said pusher to said float, each of said casings including an interior having a protrusion formed therein, each of said third legs of said pusher including a plurality of depression formed therein for engagement with said protrusion of said casing so that said protrusion can be engaged with a selected one of said depressions such that said pusher can be adjusted upward and downward relative to said float, a catch laterally extended from said float, a lever having a middle portion pivotally supported in an upper portion of said water tank and including a knob formed in a first end thereof and including a second end which is movable upward and downward when said knob is depressed and released, said second leg of said pawl being disposed above said lever and arranged such that said pawl can be caused to rotate about said hanger by said lever, said hook of said pawl being caused to move to a position located below said catch of said float when said second leg of said pawl is elevated, said knob being reachable from outside of said water tank, said valve being coupled to said second end of said lever so that said valve can be pulled open when said second end of said lever moves upward and so that water contained within said water tank can be discharged via said outlet pipe, whereby, with enough water in said tank to force said float into contact with said stop, when said knob is depressed said valve will unseat and become buoyant in said water and said water will begin to discharge out through said outlet pipe, when said knob is held upwardly said catch of said float is caught by said hook of said pawl when said float begins to move downward with the water level and said valve will reseat after almost all of the water in said tank has drained out, when said knob is released after being depressed to unseat said valve, said catch of said float will not be caught by said hook of said pawl and said float and said pusher will move downwardly along said tube in order to force said valve downwardly to close said outlet pipe before all of the water contained within said water tank is fully discharged.

2. A control device according to claim 1, wherein said second leg of said pawl includes a free end having a bent portion formed thereon so as to maintain the engagement between said pawl and said lever.

3. A control device according to claim 1, wherein said float includes a first chamber formed therein, said first chamber opens upward so that water can be contained within said first chamber and can be used as a weight.

4. A control device according to claim 1, wherein said float includes a second chamber formed therein, said second chamber opens downward so that gas can be contained within said second chamber in order to increase the buoyant capability of said float.

* * * * *